US007059933B1

(12) United States Patent
Hsiao et al.

(10) Patent No.: US 7,059,933 B1
(45) Date of Patent: Jun. 13, 2006

(54) ULTRASONIC SIGNALING INTERACTIVE TOY

(75) Inventors: Chun-Yang Hsiao, Tainan (TW); Shui-Po Ho, Tsimshatsui Kln. (HK)

(73) Assignee: Elan Microelectronics Corp., Hsinchu (TW)

( * ) Notice: Subject to any disclaimer, the term of this patent is extended or adjusted under 35 U.S.C. 154(b) by 888 days.

(21) Appl. No.: 09/695,429

(22) Filed: Oct. 23, 2000

(30) Foreign Application Priority Data

Jul. 5, 2000 (TW) ..... 89211572 U

(51) Int. Cl.
*A63H 3/28* (2006.01)

(52) U.S. Cl. ..... 446/297; 446/298

(58) Field of Classification Search ..... 446/175, 446/297, 298, 299, 300, 301, 302, 303
See application file for complete search history.

(56) References Cited

U.S. PATENT DOCUMENTS 4,177,453 A * 12/1979 Collins ..... 340/171 A
4,391,224 A * 7/1983 Adler ..... 119/707
4,701,681 A * 10/1987 Koike ..... 446/454
4,973,941 A * 11/1990 Davis et al. ..... 446/297
5,085,610 A * 2/1992 Engel et al. ..... 446/175
6,246,927 B1 * 6/2001 Dratman ..... 369/63

FOREIGN PATENT DOCUMENTS

EP 1118971 A1 * 7/2001
WO WO 200015316 A2 * 3/2000

* cited by examiner

*Primary Examiner*—John A. Ricci
(74) *Attorney, Agent, or Firm*—J.C. Patents

(57) ABSTRACT

An ultrasonic signaling interactive toy comprising of at least one ultrasonic transceiver inside an interactive toy. The ultrasonic transceiver is capable of transmitting and receiving ultrasonic signals. Each interactive toy includes at least one ultrasonic transceiver for producing a response after receiving an ultrasonic signal. Since ultrasonic signals can be transmitted or received using the same circuit, power consumption and production costs are low.

11 Claims, 7 Drawing Sheets

ULTRASONIC SIGNALING INTERACTIVE TOY

CROSS-REFERENCE TO RELATED APPLICATION

This application claims the priority benefit of Taiwan application serial no. 89211572, filed Jul. 5, 2000.

BACKGROUND OF THE INVENTION

1. Field of Invention

The present invention relates to a signaling device for an interactive toy. More particularly, the present invention relates to an ultrasonic signaling interactive toy.

2. Description of Related Art

In the past, most interactive toys communicate with each other using infrared waves, radio frequency waves or by direct wiring. FIG. 1 is a circuit diagram showing a conventional infrared communication system that can be embedded within an interactive toy. The system includes an integrated circuit 10, an infrared receiver 11, an infrared transmitter 12 and an operational circuit 13. As shown in FIG. 1, each interactive toy must have at least 2 different modules including an infrared receiver 11 and an infrared transmitter 12 to carry out necessary communications. Consequently, the required circuit is rather complicated resulting in a higher production cost Similarly, the same problems apply to an interactive toy that works on radio frequency. Furthermore, power consumption of a radio frequency operated interactive toy is higher than an infrared activated interactive toy. On the other hand, using direct wiring to link up interactive toys is rather inflexible and inconvenient.

SUMMARY OF THE INVENTION

Accordingly, one object of the present invention is to provide an interactive toy that uses ultrasonic as a signal transmission medium for short distance communication, thereby simplifying the required circuit.

To achieve these and other advantages and in accordance with the purpose of the invention, as embodied and broadly described herein, the invention provides an ultrasonic signaling device to be used inside an interactive toy. The device includes an ultrasonic transceiver capable of transmitting and receiving ultrasonic signals. There is at least one ultrasonic transceiver inside each interactive toy for receiving an ultrasonic signal and acting out a response. Response from the interactive toy includes a sound, an image or other outputs produced due to a series of actions. Sound can be emitted from a loudspeaker or a buzzer. An image can be output from a display device and the image can be changed upon receiving new data via ultrasonic signaling. Furthermore, each ultrasonic signal may be designed to include a variety of signaling components so that a plurality of interactive toys may be activated to produce different responses simultaneously. Moreover, the ultrasonic signal may be digitally modulated to lower cost.

In addition, the receiving circuit of the ultrasonic transceiver may further include an interval sampling circuit for sampling ultrasonic signal at a fixed interval. When a sample includes an ultrasonic signal, a corresponding digital signal is output. On the other hand, when no ultrasonic signal is buried in a sample, a reverse-phase digital signal is output. The receiving circuit of the ultrasonic transceiver may further includes an envelope-detection circuit for converting a received ultrasonic signal back to an original digital signal just before modulation.

Because ultrasonic wave is used as a medium of signal transmission in this invention, production cost is considerably lower than devices that operate on infrared or radio frequency and yet without the inconvenience of using direct wiring. In addition, since the transceiver unit is capable of both receiving and transmitting ultrasonic signals, the circuit is very much simplified and production cost is further reduced.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
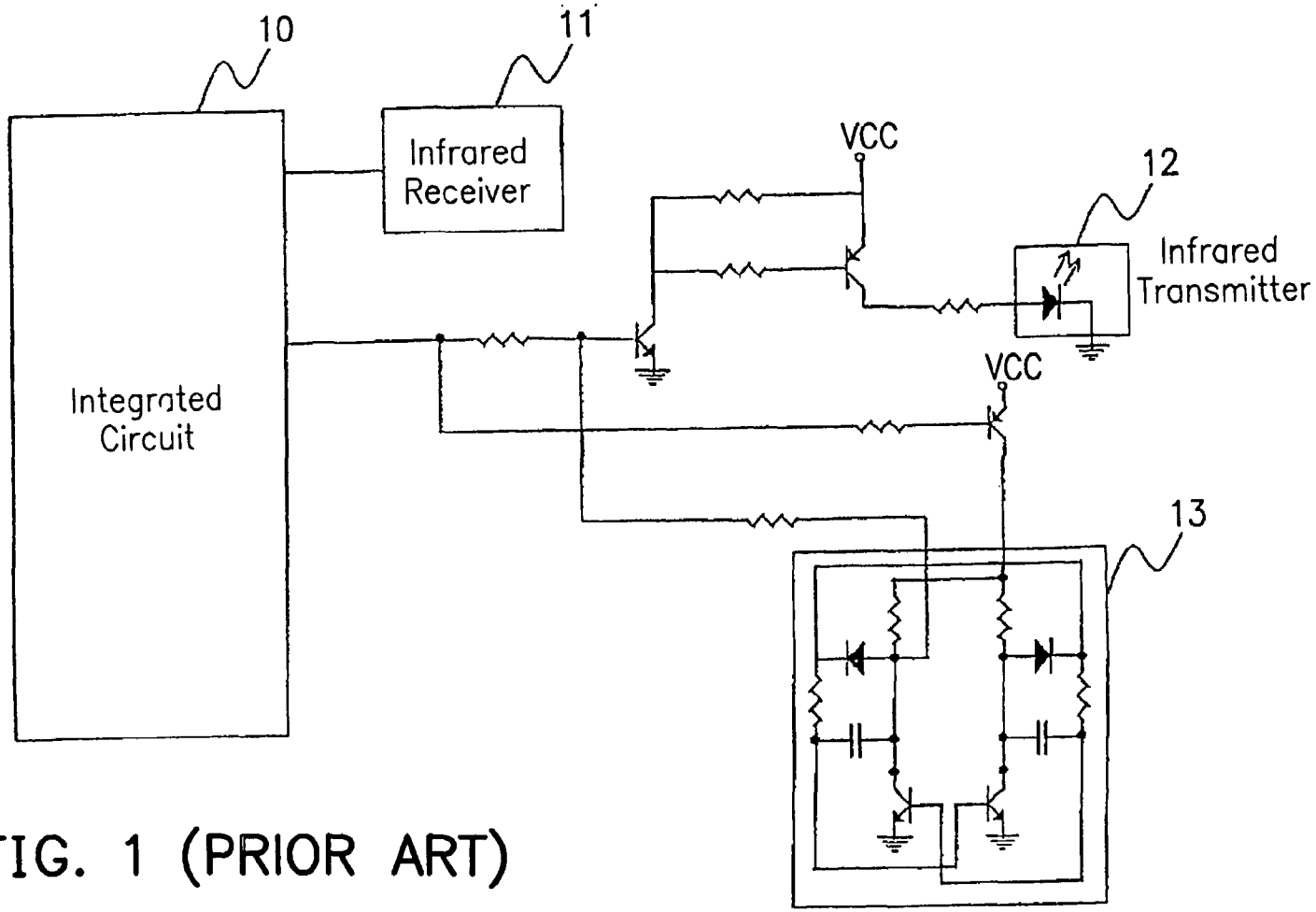
FIG. 1 (PRIOR ART)
FIG. 1 is a circuit diagram showing a conventional infrared communication system that can be embedded within an interactive toy.

Reference will now be made in detail to the preferred embodiments of the present invention, examples of which are illustrated in the accompanying drawings. Wherever possible, the same reference numbers are used in the drawings and the description to refer to the same or like parts.

The interactive toys in this invention use ultrasonic as their mutual transmission medium. Differences and useful range between ultrasonic and other conventional transmission media such as infrared and radio wave are listed out in Table No. 1 and Table No. 2 for comparison.

TABLE No. 1

Benefits and drawbacks between RF, IR and Ultrasonic

| | Benefits | Drawbacks |
|---|---|---|
| Radio Frequency (RF) | Longest transmission distance. | 1. Transmitter and receiver must be implemented using separate modules so is technically more difficult. 2. Production cost is highest. |
| Infrared (IR) | Intermediate transmission distance. | 1. Transmitter and receiver must be implemented using separate modules in addition |

TABLE No. 1-continued

| Benefits and drawbacks between RF, IR and Ultrasonic | | |
|---|---|---|
| | Benefits | Drawbacks |
| | | to directional problems.<br>2. Production cost is intermediate. |
| Ultrasonic | Shorter transmission distance. | 1. Transmitter and receiver can be implemented using the same module.<br>2. Directional problem can be resolved by adjusting transmission power.<br>3. Production cost is lowest. |

TABLE No. 2

| Frequency range between RF, IR and Ultrasonic | |
|---|---|
| Radio Frequency (RF) | 150 Mhz~450 Mhz |
| Infrared (IR) | 800~40000 Ghz |
| Ultrasonic | 20~hundreds Khz |

Since interactive toys, in general, are positioned closed to each other, shortness of communicating distance of ultrasonic is not too big of a defect. The benefits of using ultrasonic, however, are overwhelming. Directionality problems can be resolved by adjusting the power rating of the ultrasonic. The most important aspect is the capacity for integrating transmitter and receiver together in the same module, thereby reducing production cost considerably.

The ultrasonic signaling interactive toy of this invention includes an ultrasonic transceiver buried inside an interactive toy. The transceiver is capable of transmitting and receiving ultrasonic signals. Each interactive toy must have at least one ultrasonic transceiver so that the toy can output a response after receiving an ultrasonic signal.

Figure 2A:
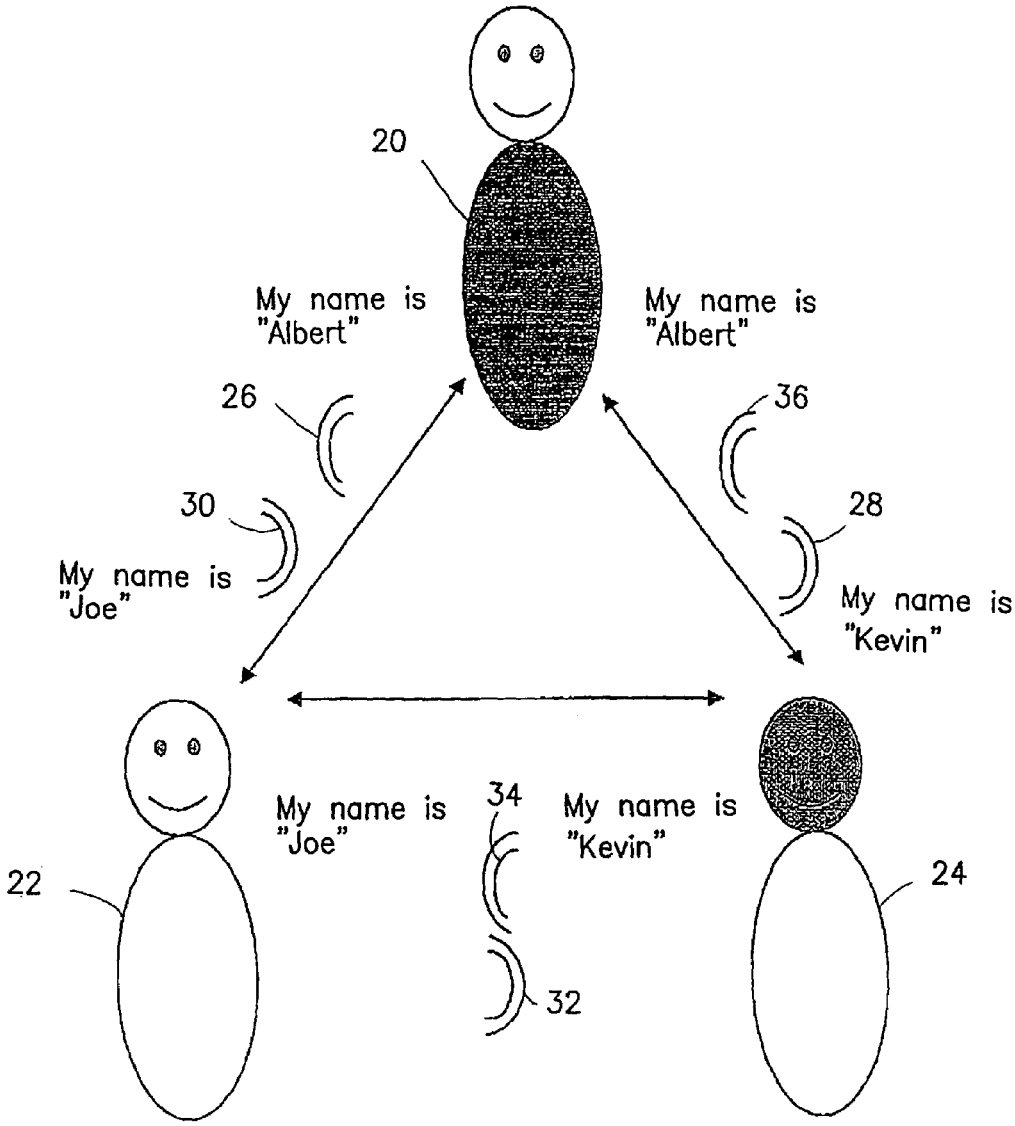
FIG. 2A is a sketch showing a group of interactive toys communicating with each other through ultrasonic signals according to a first embodiment of this invention.

FIG. 2A is a sketch showing a group of interactive toys communicating with each other through ultrasonic signals according to a first embodiment of this invention. Altogether 3 interactive toys 20, 22, 24 are shown in FIG. 2A. Each interactive toy has at least one ultrasonic transceiver. To initiate interaction between the toys, an audible sound (for example, a loudspeaker or a buzzer is used to pronounce "My name is Albert") is emitted together with an ultrasonic signal. The ultrasonic signal may include a plurality of target signals 26 and 28 each having a frequency targeting one of the interactive toys 22 and 24. Hence, several toys may be activated to produce corresponding responses. In addition, if a plurality of interactive toys uses the same ultrasonic frequency, the interactive toys receiving the target signals may function according to the content carried. For example, the interactive toy 22 emits the sound "My name is Joe" after receiving the ultrasonic signal 26 and the interactive toy 24 emits the sound "My name is Kevin" after receiving the ultrasonic signal 28. Similarly, the interactive toys 22 and 24 output a plurality of target signals 30, 32, 34 and 36 respectively.

Figure 2B:
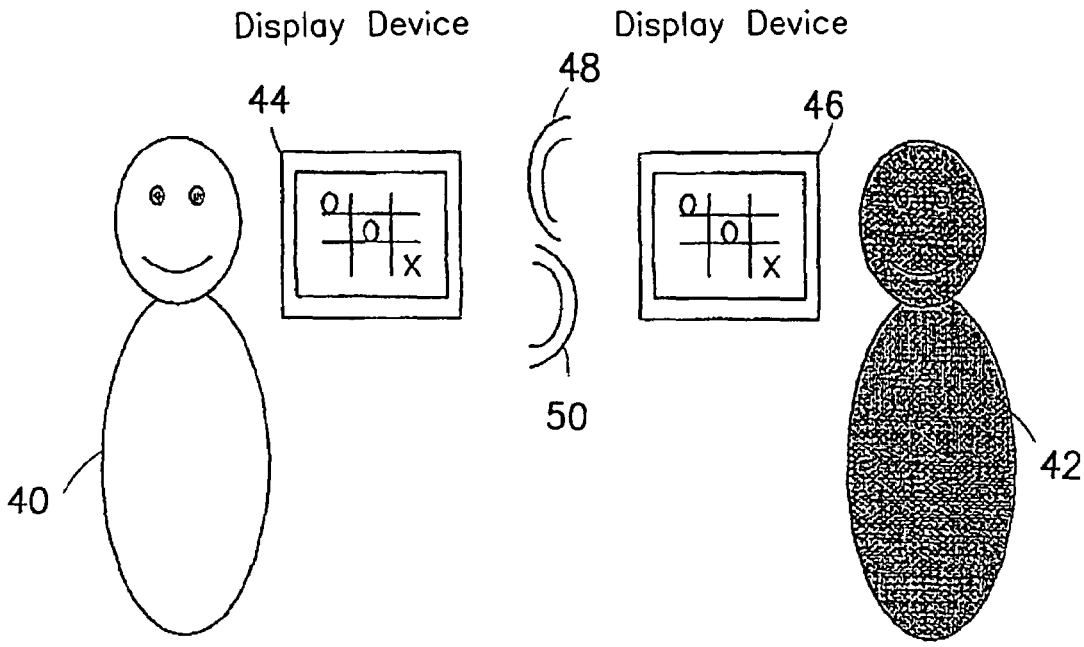
FIG. 2B is a sketch showing a group of interactive toys communicating with each other through ultrasonic signals according to a second embodiment of this invention.

FIG. 2B is a sketch showing a group of interactive toys communicating with each other through ultrasonic signals according to a second embodiment of this invention. As shown in FIG. 2B, both interactive toys 40 and 42 are able to display an image on their respective display devices 44 and 46. Moreover, the images may be changed after ultrasonic signals 48 and 50 are received by the receiving device inside each interactive toy. This type of design is most common in toys that simulate two persons having a competition. Furthermore, some actions may also be incorporated into each interactive toy in response to the ultrasonic signal received.

Figure 3:
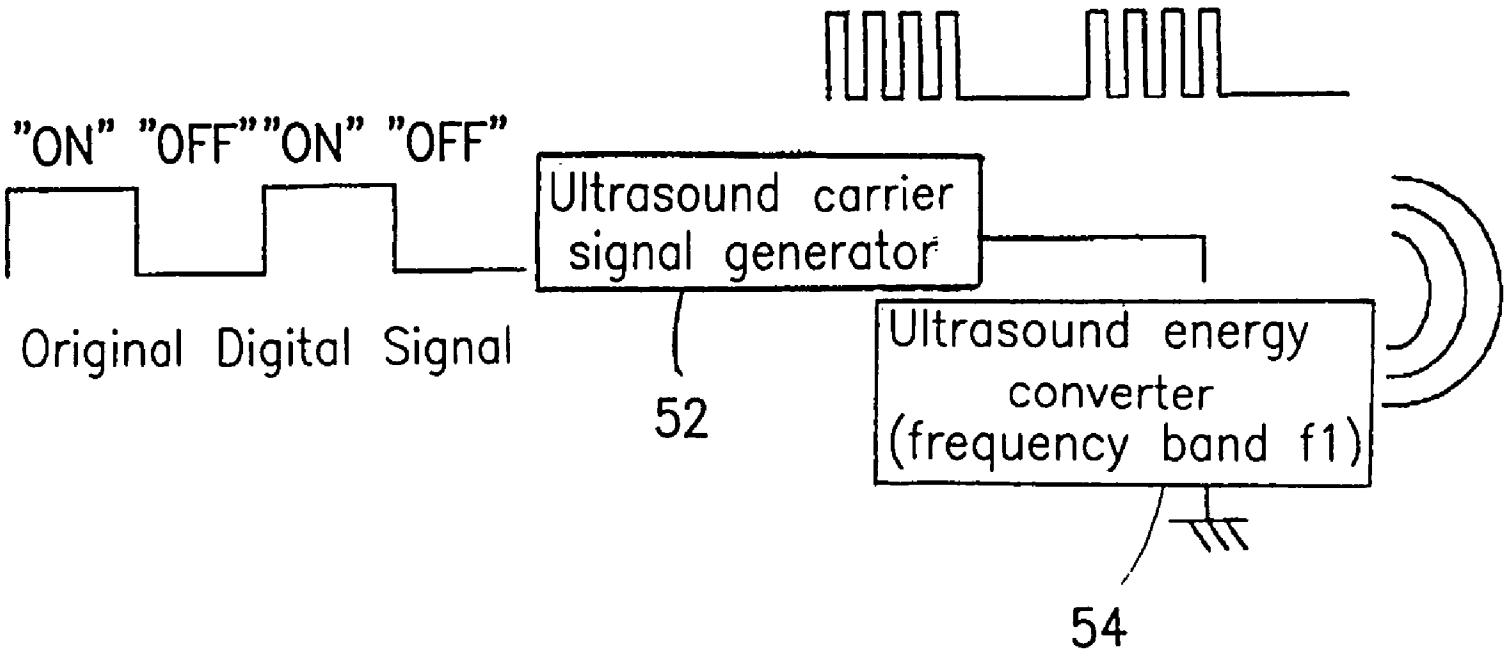
FIG. 3 is a diagram showing the manner in which ultrasonic signals are transmitted from a transmitting terminal inside an interactive toy according to the aforementioned embodiments.

FIG. 3 is a diagram showing the manner in which ultrasonic signals are transmitted from a transmitting terminal inside an interactive toy according to the aforementioned embodiments. The transmitting terminal is a device comprising an ultrasonic carrier signal generator 52 and an ultrasonic energy converter 54. The transmitting terminal is capable of transmitting digitally modulated signals. If each signal transmission session is t and the data switch is "ON" during this session, a carrier signal is introduced into the ultrasonic energy converter 54 to produce ultrasonic signals. On the other hand, if the data switch is "OFF" during this session, the transmission of ultrasonic signals is terminated. In this embodiment, digital signal modulation is used for controlling the transmission of ultrasonic signals. However, ultrasonic transmission can also be controlled by other methods including analogue signaling strength or length of signaling period.

Figure 4A:
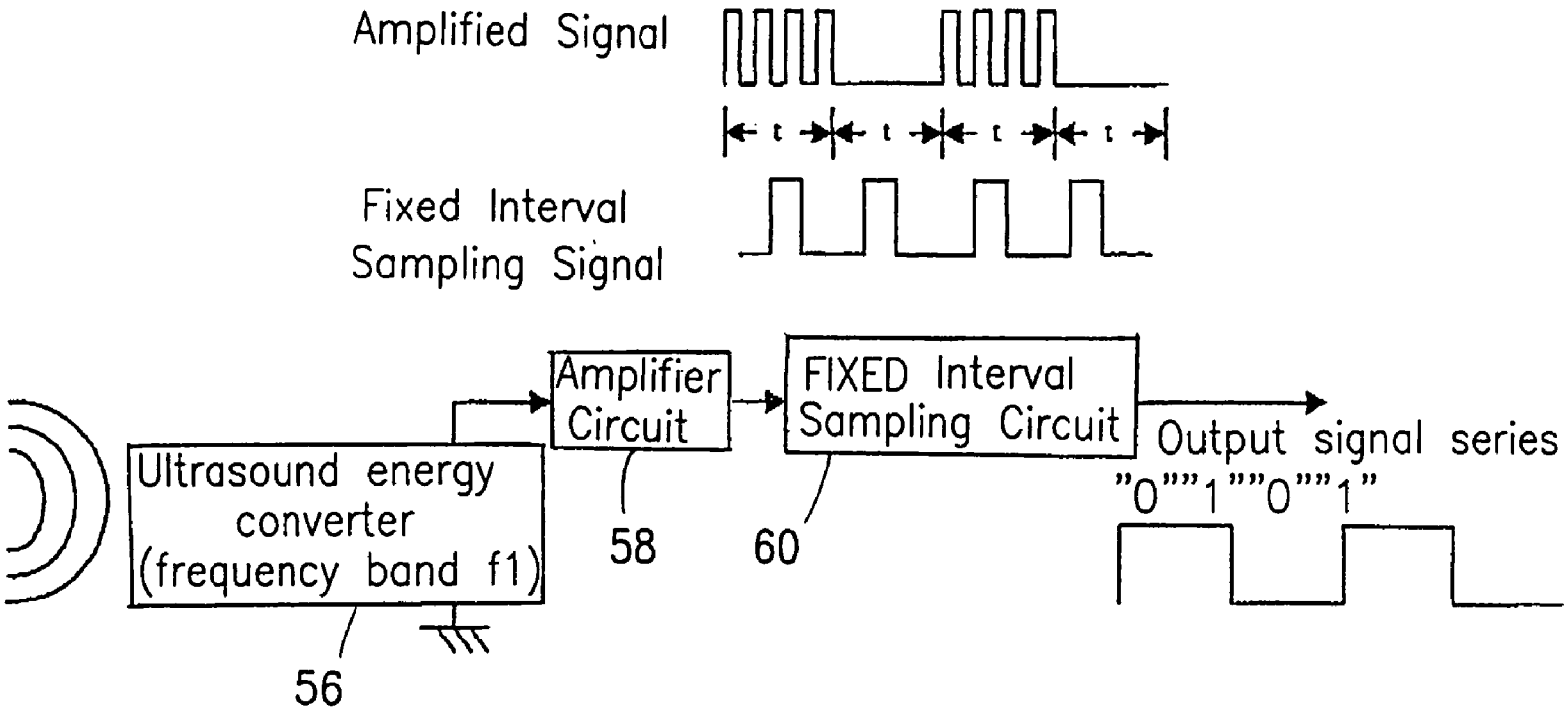
FIG. 4A is a diagram showing a first method of implementing an ultrasonic receiver for receiving ultrasonic signals inside an interactive toy.

FIG. 4A is a diagram showing a first method of implementing an ultrasonic receiver for receiving ultrasonic signals inside an interactive toy. Aside from the ultrasonic energy converter 56, FIG. 4A further includes an amplifier circuit 58 and a fixed interval sampling circuit 60. The amplifier circuit 58 amplifies the signals from the ultrasonic energy converter 56. The sampling circuit 60 samples from the ultrasonic signal at each fixed interval. If the sample contains an ultrasonic signal, a digital signal (such as '1') is issued. On the other hand, if the sample does not contain an ultrasonic signal, a reverse-phase digital signal (such as '0') is issued.

Figure 4B:
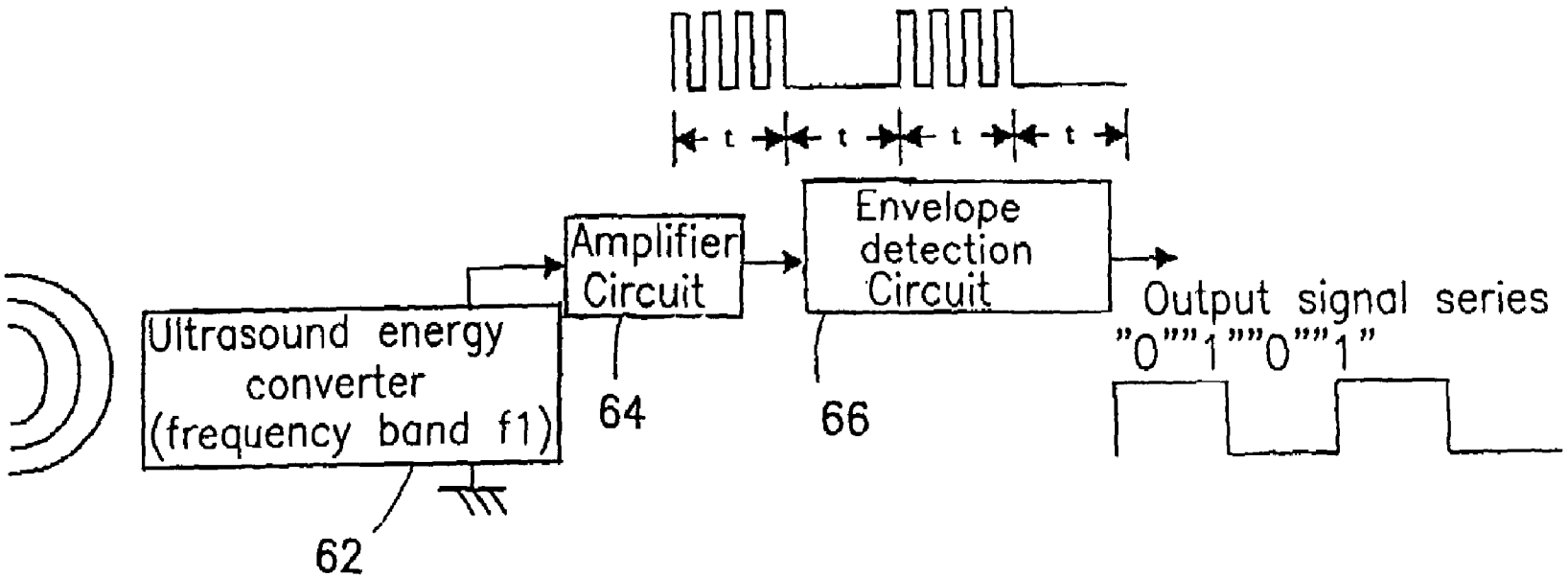
FIG. 4B is a diagram showing a second method of implementing an ultrasonic receiver for receiving ultrasonic signals inside an interactive toy.

FIG. 4B is a diagram showing a second method of implementing an ultrasonic receiver for receiving ultrasonic signals inside an interactive toy. Aside from the ultrasonic energy converter 62, FIG. 4B further includes an amplifier circuit 64 and an envelope-detection circuit 66. The amplifier circuit 64 amplifies the signals from the ultrasonic energy converter 62. The envelope-detection circuit 66 converts the received ultrasonic signal back to the original digital signal before modulation. If the output from the inspection circuit 66 contains an ultrasonic signal, a digital signal (such as '1') is issued. On the other hand, if the output from the inspection circuit 66 does not contain an ultrasonic signal, a reverse-phase digital signal (such as '0') is issued.

Figure 5:
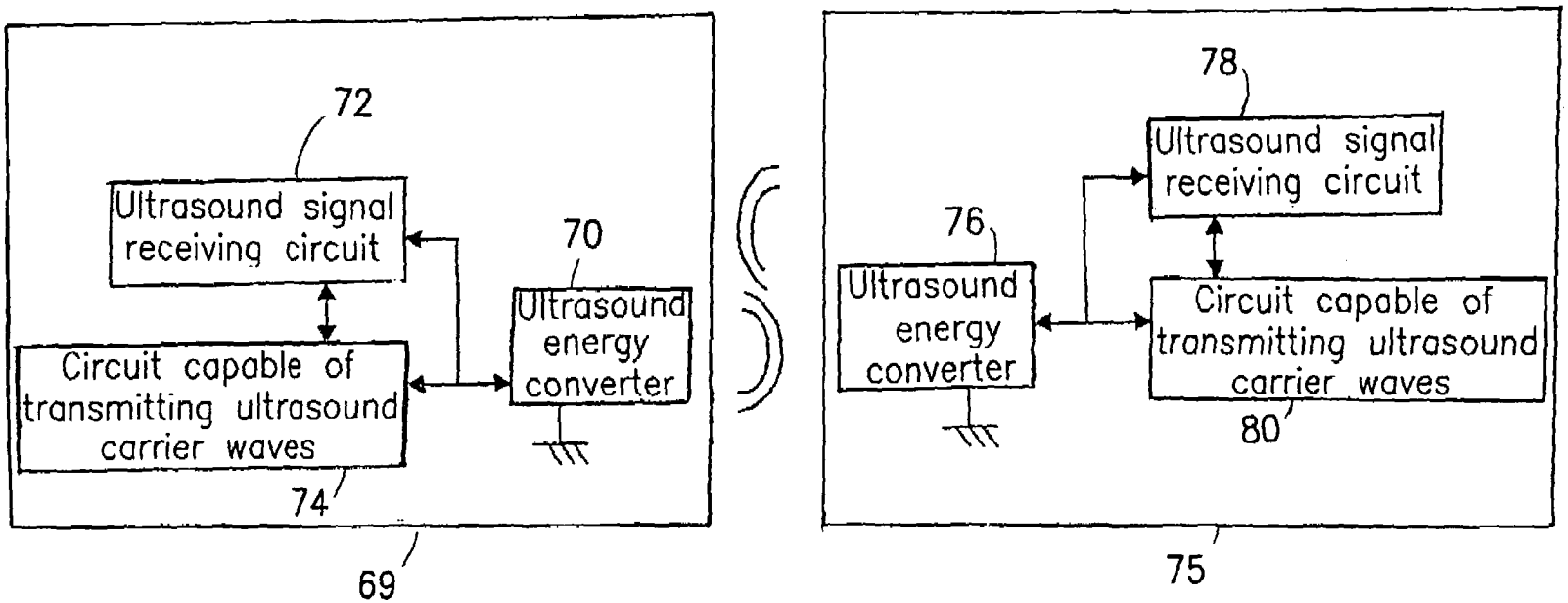
FIG. 5 is a block diagram showing interactive toys of this invention communicating with each other using ultrasonic signals with each interactive toys using a common ultrasonic energy converter as transmitter and receiver.

FIG. 5 is a block diagram showing interactive toys of this invention communicating with each other using ultrasonic signals with each interactive toys using a common ultrasonic energy converter. Since signaling time is rather short, there is no need to transmit and receive ultrasonic signals at the same time because slightly out of synch signals can hardly be noticed. As shown in FIG. 5, the ultrasonic transceiver 69 on the left side includes an ultrasonic energy converter 70, an ultrasonic signal receiving circuit 72 and a circuit 74 for transmitting ultrasonic carrier waves. Similarly, the ultrasonic transceiver 75 on the right side includes an ultrasonic energy converter 76, an ultrasonic signal receiving circuit 78 and a circuit 80 for transmitting ultrasonic carrier waves. Consequently, the combination of an ultrasonic energy converter with an ultrasonic signaling circuit and a circuit capable of transmitting ultrasonic carrier wave can eliminate a separate transmitter and receiver in infrared and radio wave devices.

In brief, the ultrasonic signaling interactive toy of this invention uses the same circuit module for transmitting and receiving signals. Hence, power consumption and production costs are reduced.

Obviously, minor alterations can also be incorporated into the design of the ultrasonic signaling interactive toy of this invention for improved performance. For example, the ultrasonic transceiver can include two ultrasonic energy converters that integrate with the receiving circuit and the circuit for transmitting ultrasonic carrier wave to form an ultrasonic receiver and an ultrasonic transmitter. Although one more ultrasonic energy converter is required, positioning of the transmitter and receiver is more flexible in addition to the capacity for simultaneous transmission and reception of ultrasonic signals.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

The invention claimed is:

1. An ultrasonic signaling interactive toy, comprising:

an ultrasonic transceiver for transmitting and receiving ultrasonic signals, wherein the ultrasonic signals are transmitted with respect to a sequence of time periods to form a digital modulation signal; and an interactive toy having at least one internal transceiver capable of producing a response after receiving the digital modulation signal, wherein a content of the digital modulation signal is determined by whether or not the ultrasonic signal is exiting with respect to the time periods, so as to recover a content carried by the digital modulation signal.

2. The interactive toy of claim 1, wherein the digital modulation signal comprises a data information or an instruction.

3. The interactive toy of claim 1, wherein the response comprises one selected from the group consisting of an audible sound, and image output, and a motion.

4. The interactive toy of claim 1, wherein the ultrasonic signal includes a plurality of target messages for informing a plurality of interaction toys at the same time so that each interactive toy can produce a corresponding response.

5. The interactive toy of claim 1, wherein the ultrasonic transceiver further includes a fixed interval sampling circuit for receiving the ultrasonic signal and sampling at fixed intervals so that a corresponding digital signal is output when the sample contains an ultrasonic signal and a reverse-phase digital signal is output when the sample does not contain an ultrasonic signal.

6. The interactive toy of claim 1, wherein the ultrasonic transceiver further includes a wave inspection circuit for receiving the ultrasonic signal and converting the ultrasonic signal back to the original digital signal before signal modulation.

7. The interactive toy of claim 1, wherein the interactive toy further includes an ultrasonic energy converter for transmitting and receiving ultrasonic signals at different times.

8. An interactive toy using an ultrasonic wave to transmit a signal, the interactive toy comprising:

an ultrasonic transceiver, used to transmit and receive an ultrasonic signal, so as to have an interactive response between the interactive toy and another one of the interactive toy, wherein the ultrasonic signal include a digital modulation signal, wherein a content of the digital modulation signal is determined by whether or not the ultrasonic signal is exiting with respect to the time periods, so as to recover a content carried by the digital modulation signal.

9. The interactive toy of claim 8, wherein the ultrasonic signal includes an image signal.

10. The interactive toy of claim 8, wherein the ultrasonic transceiver includes a fixed interval sampling circuit for receiving the ultrasonic signal and sampling at fixed intervals, or an envelope detection circuit for detecting whether or not the ultrasonic signal exist within the time periods.

11. The interactive toy of claim 8, wherein the ultrasonic transceiver includes a wave inspection circuit.

* * * * *